US012753656B2

(12) United States Patent
Sewell et al.

(10) Patent No.: US 12,753,656 B2
(45) Date of Patent: Oct. 6, 2026

(54) DRILLING MACHINE ATTACHMENT FOR LOADER

(71) Applicant: The Charles Machine Works, Inc., Perry, OK (US)

(72) Inventors: Cody L. Sewell, Perry, OK (US); Travis W. Woodson, Orlando, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 19/008,116

(22) Filed: Jan. 2, 2025

(65) Prior Publication Data

US 2025/0215748 A1 Jul. 3, 2025

Related U.S. Application Data

(60) Provisional application No. 63/616,980, filed on Jan. 2, 2024.

(51) Int. Cl.
*E21B 7/04* (2006.01)
*E21B 19/16* (2006.01)

(52) U.S. Cl.
CPC ..... *E21B 7/046* (2013.01); *E21B 19/164* (2013.01)

(58) Field of Classification Search
CPC ..... E21B 19/161; E21B 19/164; E21B 7/046; E21B 7/02; E21B 7/024; E21B 7/026; E21B 7/027; E21B 7/028
See application file for complete search history.

(56) References Cited

U.S. PATENT DOCUMENTS

| | | | | |
|---|---|---|---|---|
| RE38,418 | E | 2/2004 | Deken et al. | |
| 6,739,413 | B2 | 5/2004 | Sharp et al. | |
| 7,011,166 | B2 | 3/2006 | Koch et al. | |
| 8,485,287 | B2 | 7/2013 | Sewell | |
| 10,221,540 | B2 | 3/2019 | Azure et al. | |
| 11,180,962 | B2 | 11/2021 | Dorin | |
| 11,828,176 | B2 | 11/2023 | Slaughter, Jr. et al. | |
| 2020/0199940 | A1* | 6/2020 | Auer | E21B 7/024 |
| 2022/0325582 | A1* | 10/2022 | Stephens | E02F 3/96 |
| 2022/0412166 | A1* | 12/2022 | Herrick | E21B 19/083 |

OTHER PUBLICATIONS

Integrity Rail Products, "Easy Drill", company website retrieved Apr. 22, 2025, https://integrityrailproducts.com/products/easydrill/, 1 page.

* cited by examiner

*Primary Examiner* — Kristyn A Hall
(74) *Attorney, Agent, or Firm* — Tomlinson McKinstry, P.C.

(57) ABSTRACT

A drill attachment for a work machine. The attachment has a drill frame which supports a spindle and carriage for rotating and translating a pipe segment, or a made up section of pipe. A wrench is utilized to make up and break out sections of pipe from a pipe string. The attachment is carried by a compact work machine's lift arms, and is generally oriented such that the path of the drill string is perpendicular to the path of the lift arms. The drill attachment is powered by the prime mover of the work machine, through hydraulic, electrical, or other connections.

19 Claims, 5 Drawing Sheets

DRILLING MACHINE ATTACHMENT FOR LOADER

SUMMARY

The present invention is directed to a work machine. The work machine comprises a compact utility loader and a drill. The compact utility loader comprises a loader frame, a prime mover disposed within the loader frame, at least one motive ground engaging member, and a lift arm. The at least one motive ground engaging member is attached to the loader frame and configured to translate the loader frame. The lift arm is pivotally attached to the loader frame.

The drill comprises a drill frame, a carriage, a spindle, and a wrench. The drill frame is attachable to the lift arm. The carriage is movable along the drill frame and powered by the prime mover. The spindle is carried by the carriage and configured to rotate a drill string. The spindle is powered by the prime mover. The wrench is configured to make up a break out pipe segments from the drill string, and is powered by the prime mover.

In another aspect, the invention is directed to a drilling system. The drilling system comprises a prime mover, a compact utility loader, and a drill. The compact utility loader comprises a motive force means and a lift arm. The lift arm is configured for connection to a plurality of attachments. The drill comprises a drill frame, a spindle, and a wrench. The drill frame is attached to the lift arm. The spindle and the wrench are powered by the prime mover. The prime mover is not supported on the drill frame.

DETAILED DESCRIPTION

Figure 1:
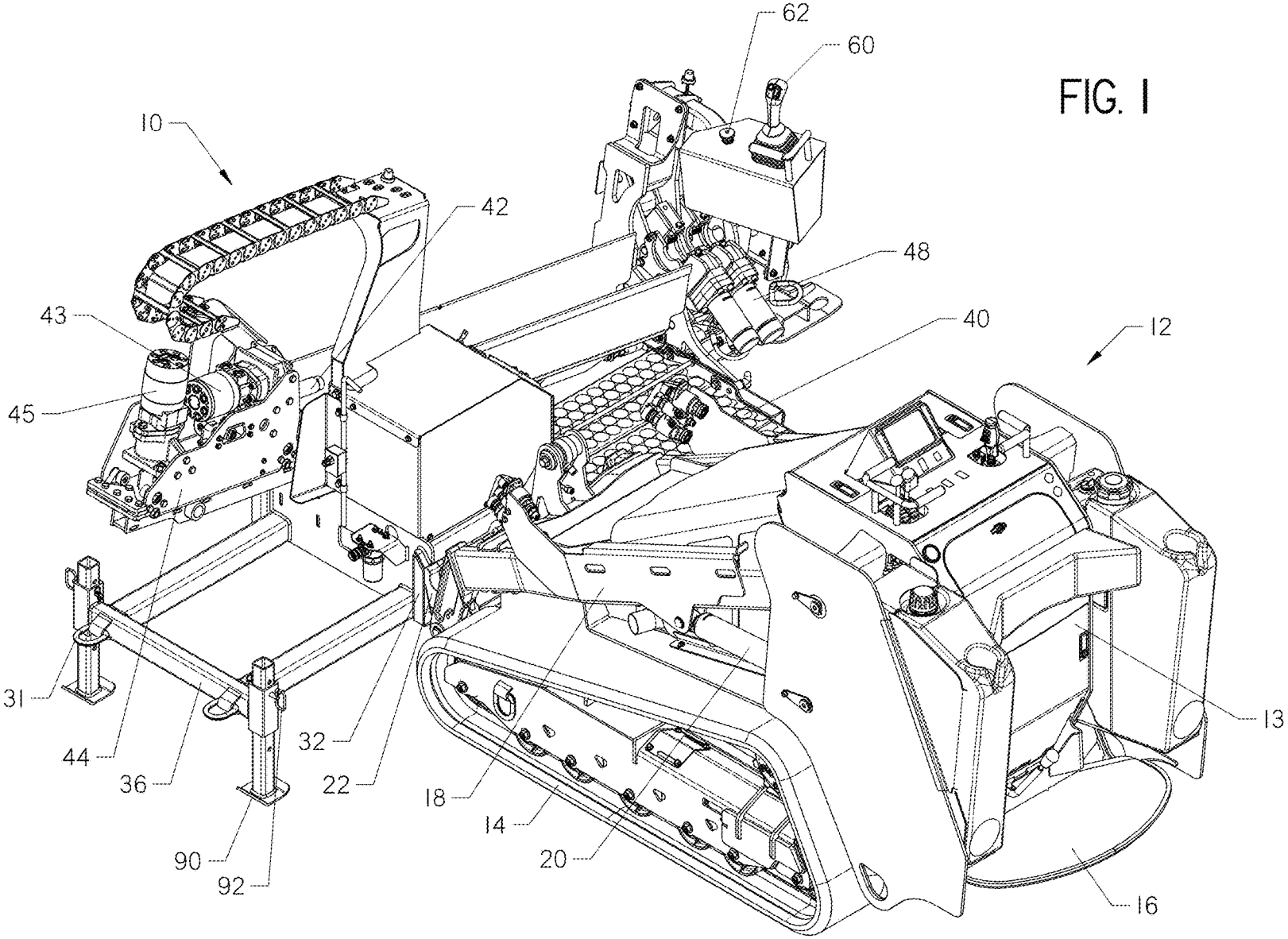
FIG. 1 is a back left top view of a compact skid loader with a drilling machine attachment. The drilling machine attachment is attached at a right connection point, thus its drilling axis is transverse to a longitudinal axis, or forward path of travel, of the skid steer machine.

Turning now to the figures, FIG. 1 shows a drilling machine attachment 10 connected to a compact skid loader 12. The compact skid loader 12 comprises a machine frame 13 which is supported by a motive force means 14, here, a pair of tracks. The motive force means 14 are powered by a prime mover located onboard the compact skid loader 12. The skid loader 12 comprises an operator station 16 and a pair of loader arms 18.

The loader arms 18 and motive force means 14 are operable from the operator station 16 by an operator, who may be standing on or walking behind the operator station 16. The loader arms 18 are raised and lowered by an actuator 20, such as a pair of hydraulic cylinders. Typically, loader arms 18 will have an attachment, such as a bucket, plow, fork, or other tool disposed at its distal end.

In FIG. 1, the loader arm has an attachment plate 22 which is attached to the drilling machine attachment 10. The features of the compact skid loader are common in the industry. The compact skid loader 12 will have a prime mover supported by its frame 13. The prime mover may be a gasoline or diesel engine, which powers the tracks 14 and hydraulics 20. The prime mover may alternatively comprise a battery bank to actuate electric components such as motors and actuators. Typically, the prime mover also is hydraulically and/or electrically connected to components of an attachment.

Figure 2:
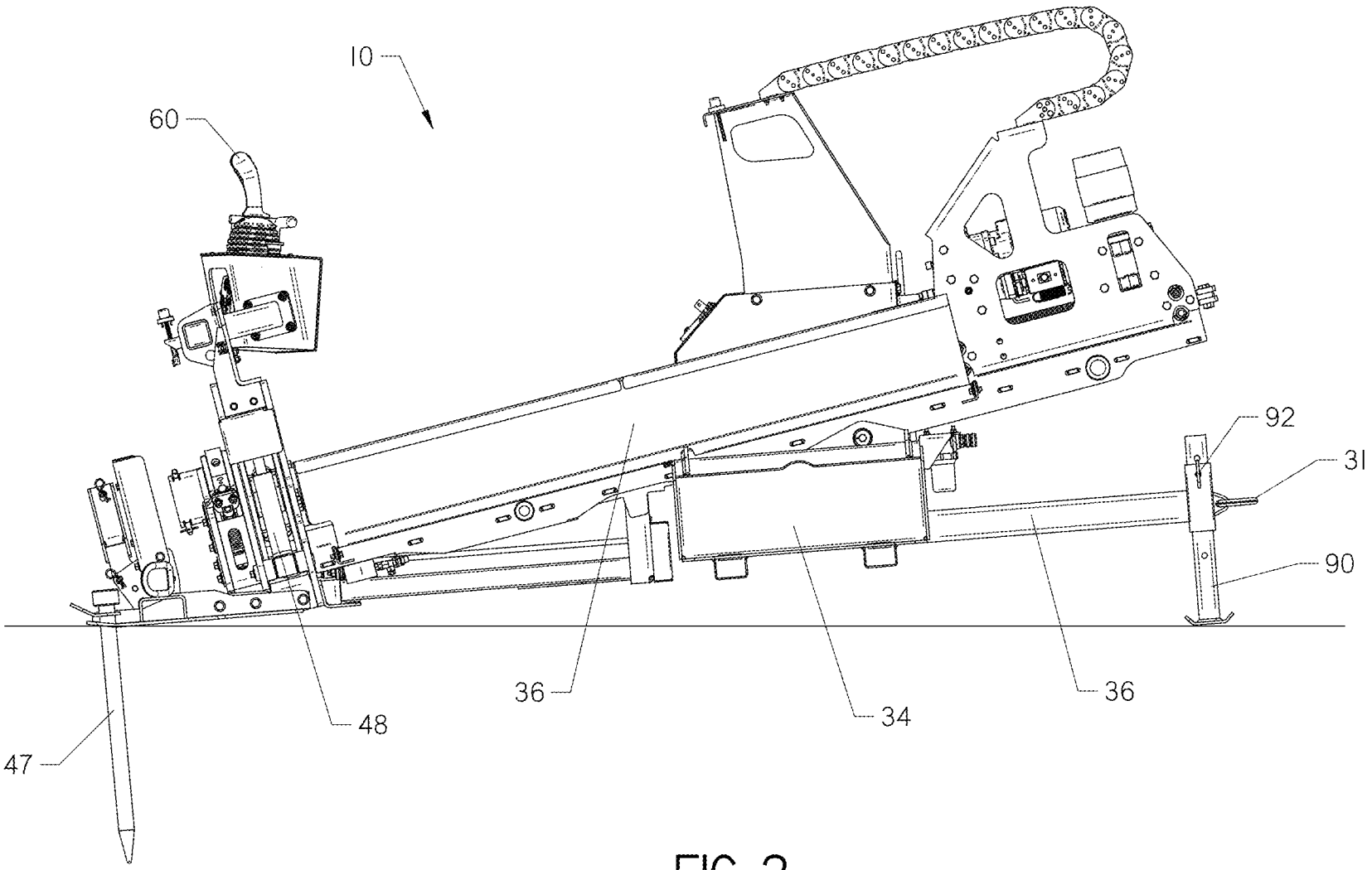
FIG. 2 is a left side view of the drilling machine attachment, with a ground level shown such that a spike is driven through the frame of the drilling attachment for stability. Pipe which may be contained in the pipe box is removed for clarity.
Figure 3:
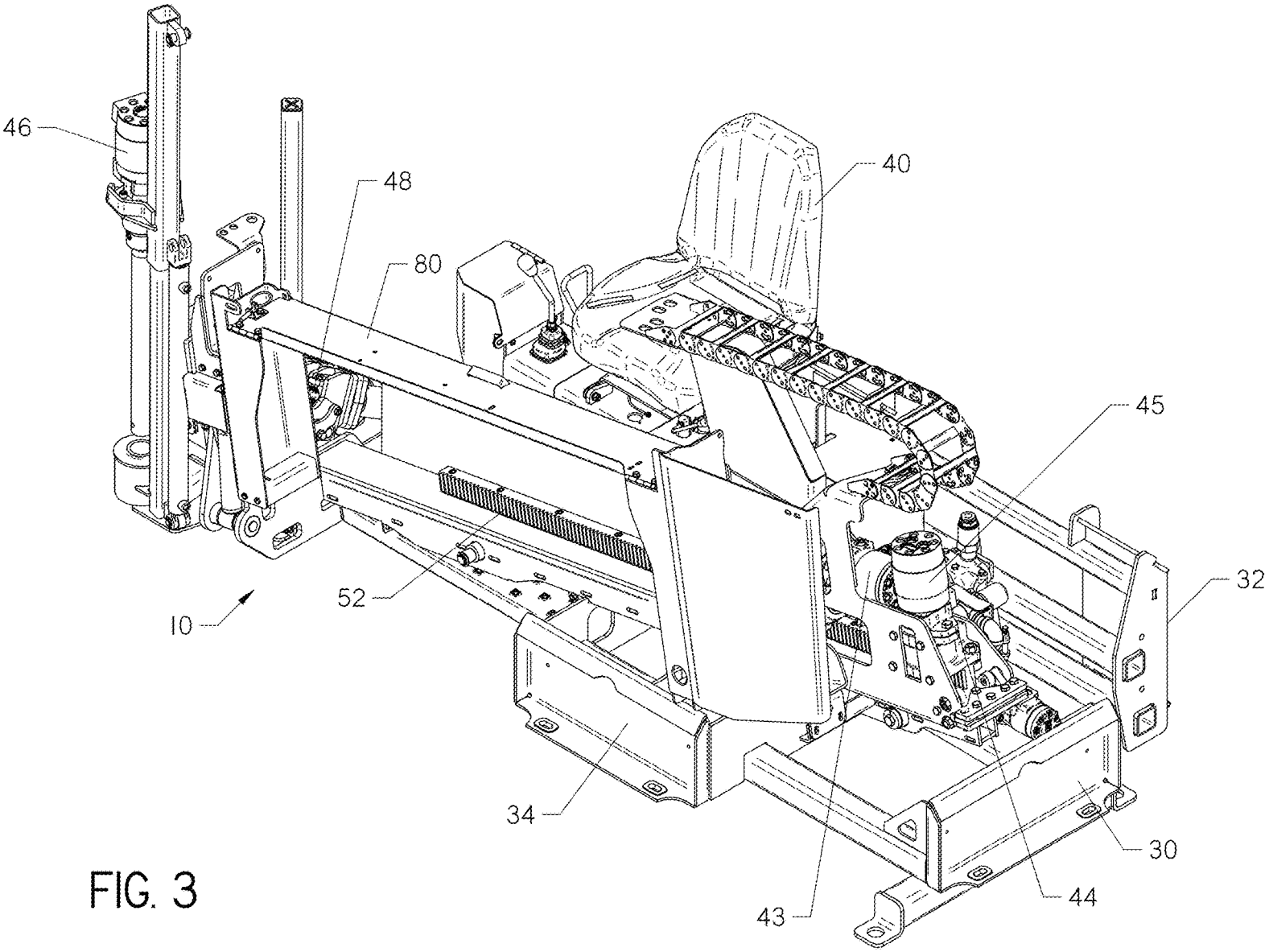
FIG. 3 is a back left top view of an alternative drilling machine attachment, having a seated operator station and powered drill frame anchors. The skid steer machine is not attached. Pipe which may be contained in the pipe box is removed for clarity.
Figure 4:
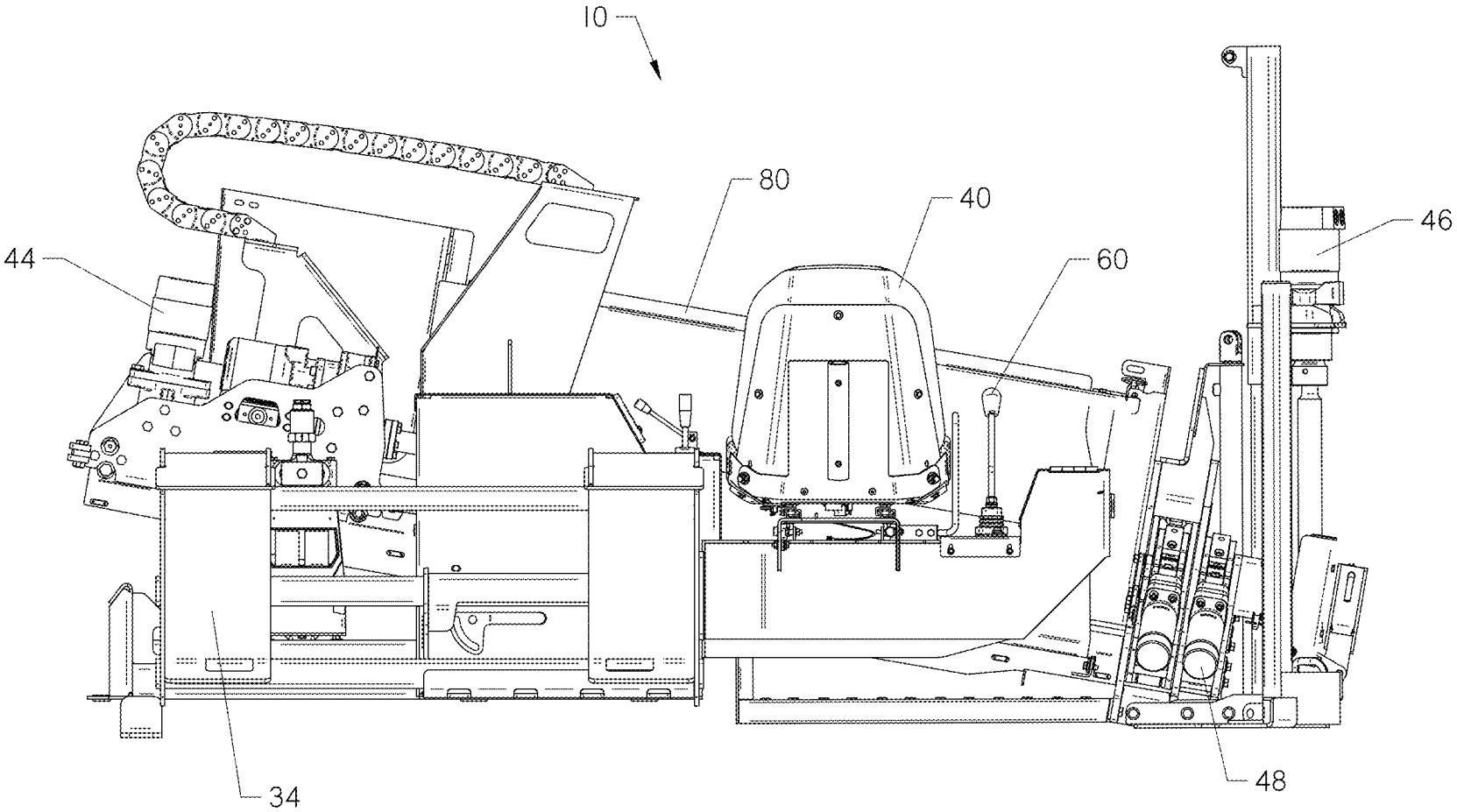
FIG. 4 is a right side view thereof.

With reference to FIGS. 2-4, the drilling machine attachment 10 is shown in more detail. Small drills are known in the art to be stand-alone machines, with their own prime movers to power various portion of the drill. However, it may be advantageous for a drilling attachment to be provided which is capable of being powered by an offboard prime mover, such as in the embodiment of FIG. 1.

The drilling machine attachment 10 shown in this disclosure is configured to operate without its own prime mover, and is instead connected to a remote prime mover, such as the prime mover of the compact skid loader 12. The prime mover of the compact skid loader 12 may connect to various motors on the drilling machine attachment 10 by hydraulic supply lines (for hydraulic motors) or cables (if electric power is used). For clarity in the Figures, these mere connections are not shown.

Alternatively, a connection to another external power source may enable the use of components of the drilling machine attachment 10. For example, a power pack or battery bank may be carried to a location of a boring operation. The compact skid loader 12 transports the drilling machine attachment 10 to the location, where the attachment 10 is connected to the remote source of power for the drilling operation. In either configuration, however, no prime mover located on the drilling machine attachment 10 provides power to its components.

As shown in FIGS. 3-4, the drilling machine attachment 10 may comprise a rear attachment point 30 at its back end. The rear attachment point 30 is configured to attach to the attachment plate 22 of the compact skid loader 12. The rear attachment point 30 may be used when the drilling machine attachment 10 is moved, as the overall machine will have a more narrow profile length-wise. For example, when the drilling machine attachment 10 needs to move through a cramped area, such as a gate, it may be necessary to use the rear attachment point to avoid damage to property. However, such a rear attachment point 30 may cause the center of gravity of the assembled loader 12 and attachment 10 to be too far forward, and may therefore be removed if desired, as in FIGS. 1-2. In FIGS. 1-2, eyes 31 may be used to tow or lift the attachment 10.

The drilling machine attachment 10 further comprises a first side attachment point 32 and a second side attachment point 34 disposed on opposite sides of a drilling frame 36 of the attachment 10. Connection of the compact skid loader 12 to the first side 32 or second side 34 attachment point allows the drilling machine attachment 10 to be placed precisely at the location of a drilling operation. Further, the weight of the compact skid loader 12 being disposed at a side of the drilling attachment 10 and connected thereto provides additional stability for the machine as drill pipe (not shown) is placed into the ground. In this context, the path of travel of the motive force members 14 will be transverse to the drilling axis of the attachment 10.

The drilling machine attachment 10 comprises an operator station 40 from which elements of the attachment are controlled. In FIG. 1, this operator station 40 is a stand-on platform. In FIGS. 3-4, the operator station 40 comprises a seat. If eliminating weight is desired, a platform, such as platform 41 in FIGS. 1-2 and 5 may be advantageous.

Elements controlled from the operator station 40 include, but are not limited to, a spindle 42, a carriage 44 for translating the spindle along the frame, one or more drilling anchors 46 (FIG. 3-4), a wrench 48, and a fluid pump. Weight may be removed from the attachment 10 by replacing powered drill anchors with a spike 47, as shown in FIG. 2.

Figure 5:
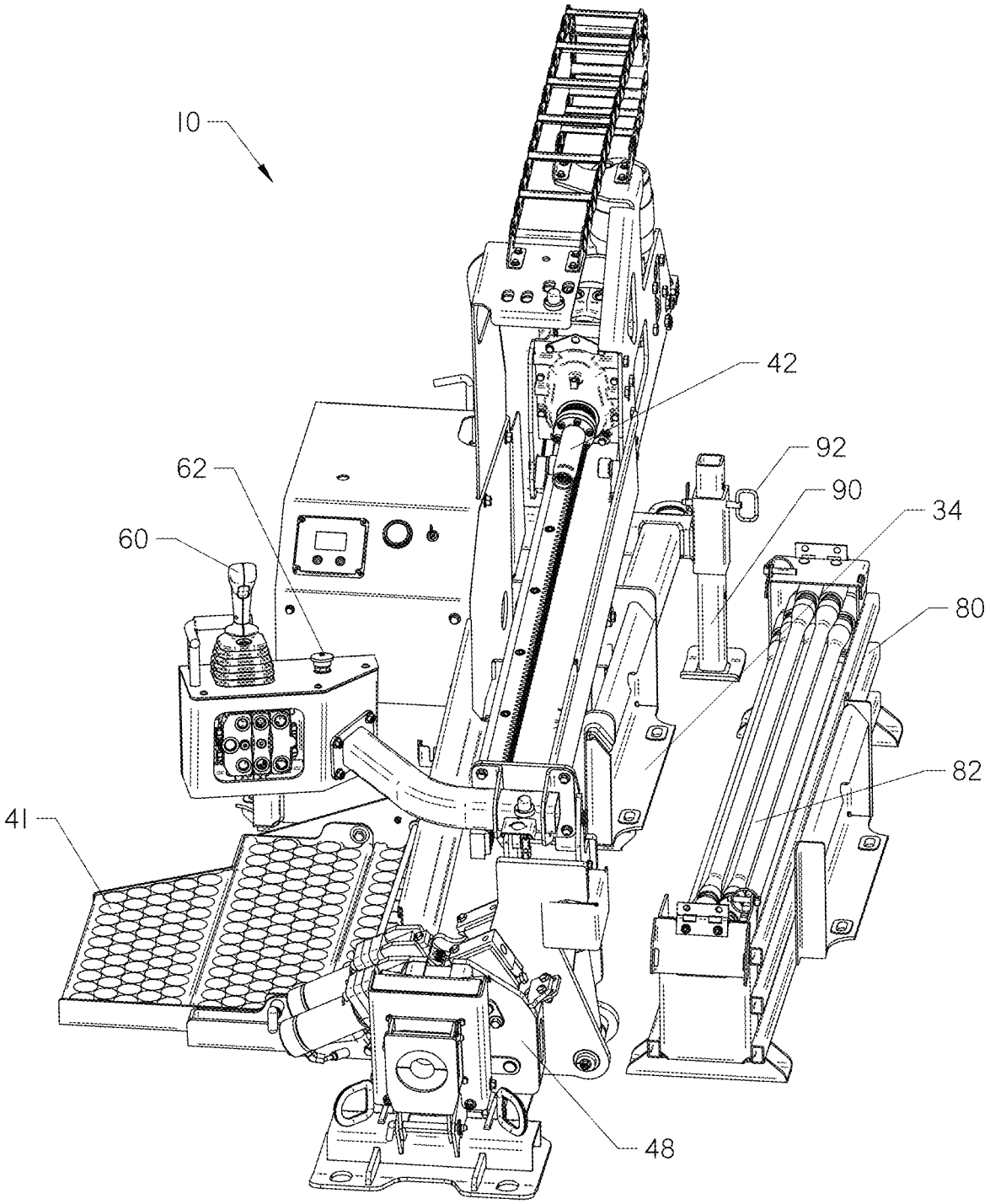
FIG. 5 is a front view of the machine with drill attachment of FIGS. 1 and 2 with a pipe box containing pipe segments

The fluid pump may be maintained on an offboard fluid supply apparatus, but controlled from the operator station 40. As shown, the operator station has a standing platform and a joystick 60 for actuation of the spindle 42 and carriage 44, as well as controls, such as a button 62, to actuate the wrench 48. The wrench 48, when actuated, may perform an automated set of steps to make up or break out sections of pipe 82 (FIG. 5).

The spindle 42 is configured to attach to, and rotate sections of pipe. This function is important both for threading pipe sections together, and for rotating the drill string as it travels through the ground. The spindle 42 is powered by a spindle motor 43 which receives its energy from a power pack located on the compact skid loader 12, rather than the drilling machine attachment 10.

The carriage 44 supports the spindle 42, and is configured to move the spindle 42 along the frame of the drilling machine attachment 10. As shown in FIG. 3, the carriage 44 may translate by rotation of a pinion by a carriage motor 45 which interacts with a rack 52. In operation, the carriage 44 advances the drill string into the ground, then retracts for addition of an additional pipe section. Alternatively, during pull-back of a drill string, the carriage 44 operates to pull the drill string out of an underground environment, then, after removal of a pipe section, moves forward to allow the spindle 42 to connect to an additional section of pipe. The carriage motor 45 receives its energy from the prime mover located on the compact skid loader 12 rather than the drilling machine attachment 10.

Drill anchors 46 stabilize the drill attachment 10 by extending into an underground surface. As shown, the drill anchors 46 are proximate the wrench 48, where high-torque conditions may exist. By anchoring the drill attachment, the drill anchors 46 prevent damage to and unwanted movement of the drill attachment 10. Drill anchors, if used are actuated by the prime mover on the compact skid loader 12. Alternatively, spikes 47 (FIG. 2) may be driven through a hole in the drill frame 36.

The wrench 48 provides high torque at a pipe joint between adjacent sections of pipe as the drill string is being made up or broken out. The wrench 48 is powered by the prime mover on the work vehicle.

The fluid pump circulates drilling fluid into and out of the drill string. Drilling fluid is provided to enhance drilling operations at the downhole tool, and circulating drilling fluid helps to remove spoils and keep a downhole tool from unwanted damage.

As shown, the various motors powering necessary portions of the drill attachment 10 are hydraulic motors, and the prime mover or power pack on the compact skid loader 12 provides pressurized hydraulic fluid to operate these motors through conduits or hoses (not shown). Alternatively, electric motors may be utilized, and the power pack may provide an electric current to drive such motors.

The angle of the drill frame 36 may be adjusted by changing a position of an adjustable foot 90 (FIGS. 1-2). A pin 92 can be removed from the drill frame 36. The drill frame 36 may be lifted by the lift arms 18. Once lifted, the feet 90 may be freely moved within the drill frame 36 and the height of the feet 90 relative to the drill frame 36 set by placement of the pin 92. The drill frame 36 is then lowered by the lift arms 18 and placed on the ground surface at an angle. In FIG. 1, the feet 90 are fully retracted, while in FIG. 2, the feet 90 are extended. Adjustment of the feet 90 allows the initial angle of the drilling operation to be changed.

With reference to FIG. 5, a pipe box 80 may contain multiple pipe sections 82, which can be removed by for placement proximate the spindle 42 for attachment thereto. During breakout, pipe sections 82 may be removed from the spindle 42 for placement back into the pipe box 80. The individual pipe sections 82 may be removable by hand from the pipe box 80 for threading to the spindle 42 or may be removed by a shuttle arm (not shown). Preferably, the pipe box is removable from the drilling frame 36 of the drilling attachment 10.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

For example, while a "skid loader" is described, the attachment 10 of this invention may be supported by a loader with other steering methods, such as a steerable axle, without departing from the spirit of the invention.

The invention claimed is:

1. A work machine, comprising:

a compact utility loader, comprising:

a loader frame;

a prime mover disposed within the loader frame;

at least one motive ground engaging member attached to the loader frame and configured to translate the loader frame; and a lift arm, pivotally attached to the loader frame;

a drill, comprising:

a drill frame attachable to the lift arm;

a carriage, movable along the drill frame and powered by the prime mover;

a spindle, carried by the carriage and configured to rotate a drill string, wherein the spindle is powered by the prime mover; and a wrench, configured to make up and break out pipe segments from the drill string, wherein the wrench is powered by the prime mover;

in which the drill frame is attached to the lift arm such that the direction of translation of the loader frame is transverse to the direction of movement of the carriage along the drill frame.

2. A system comprising:

the work machine of claim 1; and a pipe box containing a plurality of pipe segments, each of the plurality of pipe segments being configured for attachment to the spindle.

3. The work machine of claim 1 further comprising:

a pair of feet disposed on the drill frame and configured for attachment to the drill frame in a plurality of configurations, in which each of the plurality of configurations adjusts a tilt of the drill frame relative to a ground surface.

4. The work machine of claim 1 in which the prime mover comprises a combustion engine.

5. The work machine of claim 1 in which the prime mover comprises a battery.

6. A work machine, comprising:

a compact utility loader, comprising:

a loader frame;

a prime mover disposed within the loader frame;

at least one motive ground engaging member attached to the loader frame and configured to translate the loader frame; and a lift arm, pivotally attached to the loader frame;

a drill, comprising:

a drill frame attachable to the lift arm;

a carriage, movable along the drill frame and powered by the prime mover;

a spindle, carried by the carriage and configured to rotate a drill string, wherein the spindle is powered by the prime mover; and a wrench, configured to make up and break out pipe segments from the drill string, wherein the wrench is powered by the prime mover;

in which the drill comprises a first attachment point and a second attachment point, in which each of the first attachment point and second attachment point are configured for attachment to the lift arms such that a direction of translation of the at least one motive ground engaging member and a direction of movement of the carriage along the drill frame are transverse.

7. The work machine of claim 6 in which the first attachment point and the second attachment point are disposed on opposite sides of the drill frame.

8. The work machine of claim 6 further comprising a third attachment point, in which the third attachment point is configured for attachment to the lift arms such that a direction of translation of the at least one ground engaging member and a direction of movement of the carriage along the drill frame are within the same plane.

9. A drilling system comprising:

a prime mover;

a compact utility loader comprising a ground engaging member and a lift arm, wherein the lift arm is configured for connection to a plurality of attachments; and a drill comprising:

a drill frame defined by opposed first and second ends and opposed first and second sides, the drill frame comprising a side attachment point disposed at the first side of the drill frame and an end attachment point disposed at a first end of the drill frame, wherein the drill frame is configured to be attached to the lift arm at a selected one of the side attachment point and the end attachment point;

a spindle powered by the prime mover; and a wrench powered by the prime mover;

wherein the prime mover is not supported on the drill frame.

10. The drilling system of claim 9 in which the prime mover is situated on the compact utility loader, and wherein the prime mover further powers the ground engaging member and the lift arm.

11. The drilling system of claim 9 further comprising a pipe box, the pipe box containing a plurality of pipe segments, wherein the plurality of pipe segments are configured for end-to-end connection.

12. The drilling system of claim 11 in which the pipe box is separate from the drill.

13. The drilling system of claim 9 in which the drill comprises an operator station disposed on the drill frame, in which the operator station comprises a control configured to operate the spindle and the wrench.

14. The drilling system of claim 13 in which the compact utility loader comprises a loader operator station, in which the loader operator station comprises a control configured to operate the motive force means ground engaging member and the lift arm.

15. The drilling system of claim 13 in which the operator station comprises a seat.

16. The drilling system of claim 9 in which the drill frame comprises at least two adjustable feet disposed on a first end of the drill frame.

17. The drilling system of claim 9 in which the drill further comprises an anchor.

18. The drilling system of claim 17 in which the anchor is powered by the prime mover.

19. The drilling machine of claim 9 in which the ground engaging member comprises a track.

* * * * *